US005803314A

United States Patent [19]

Lester

[11] Patent Number: 5,803,314

[45] Date of Patent: Sep. 8, 1998

[54] DISPENSING CLOSURE FOR A SQUEEZABLE CONTAINER

[76] Inventor: William M. Lester, 4389 White Cedar La., Delray Beach, Fla. 33445

[21] Appl. No.: 901,717

[22] Filed: Jul. 28, 1997

Related U.S. Application Data

[63] Continuation-in-part of Ser. No. 720,676, Oct. 2, 1996.

[51] Int. Cl.[6] ..... B67D 5/32

[52] U.S. Cl. ..... 222/153.14; 222/212; 222/495

[58] Field of Search ..... 222/153.14, 212, 222/495, 501, 549, 525; 251/82

[56] References Cited

U.S. PATENT DOCUMENTS

| | | | |
|---|---|---|---|
| 963,836 | 7/1910 | Varlie . | |
| 1,570,900 | 1/1926 | Liberthal | 222/495 |
| 1,721,666 | 6/1929 | Lee . | |
| 3,165,242 | 1/1965 | Jackson . | |
| 3,490,658 | 1/1970 | Schwartzman . | |
| 3,817,284 | 6/1974 | Daugherty . | |
| 3,858,773 | 1/1975 | Del Bon | 222/494 |
| 3,887,116 | 6/1975 | Ishikawa et al. . | |
| 4,203,536 | 5/1980 | Lester . | |
| 4,253,588 | 3/1981 | Lester et al. . | |
| 5,566,866 | 10/1996 | Jacobsen | 222/495 |

FOREIGN PATENT DOCUMENTS 2 364 168 9/1976 France .

*Primary Examiner*—Gregory L. Huson
*Attorney, Agent, or Firm*—William Squire

[57] ABSTRACT

A tapered valve seat and mating valve member are in fluid communication with a squeezable container interior. Fluid in the container under pressure axially displaces the valve from its seat, flows through the interface between the valve and seat and is discharged through conduits in the valve member and stem. A gradually curved undulating valve chamber ceiling wall engages a complementary curved shoulder on the valve member for limiting the axial displacement of the valve member between a locked state and a plurality of settable maximum valve interface clearances valve open states according to the relative annular positions of the shoulder to the chamber wall. The interface clearance and thus the valve maximum open position is set according to fluid viscosity to retain fluid therein to preclude ambient air passing to the container interior in response to a negative pressure in the container. This creates forces which close the valve in each relative position. A disc-like handle knob attached to the stem overlies the housing for manually rotating the valve member open and closed and for receiving indicia indicating the relative maximum clearances at the valve interface.

16 Claims, 3 Drawing Sheets

DISPENSING CLOSURE FOR A SQUEEZABLE CONTAINER

This application is a continuation-in-part of copending application Ser. No. 08/720,676 filed Oct. 2, 1996 in the name of the present inventor.

The present invention relates to dispensing closures for squeezable containers.

Of interest are commonly owned U.S. Pat. Nos. 4,203,536 and 4,253,588.

The present invention is an improvement of the invention disclosed in U.S. Pat. No. 4,203,536 ('536).

Automatic dispensing closure valves for squeezable containers include valves which open in response to greater than ambient pressure inside the container. The pressure forces the fluid in the container through the valve, opening the valve, then through a discharge orifice to the ambient. To close the valve, the valve either has to be manually returned to the closed position or, in some configurations, automatically returns to the closed position.

In the latter valves, various spring devices are provided which are placed under spring bias pressure when the valve opens. Upon reduction of pressure in the container to ambient or less, the spring bias pressure closes the valve. While it is more desirable to provide automatic closure of the valve the additional spring elements add to the cost and complexity of the apparatus.

In the closure disclosed in the aforementioned U.S. Pat. No. 4,203,536, the valve automatically returns to the closed valve condition based on pressure differentials between the container interior and the ambient atmosphere. As the disclosed pliable container is compressed to reduce its volume and force its liquid contents out of the closure conduit through the valve, the container forms a low pressure in its interior when it resiliently returns to its normal expanded state. The higher ambient atmospheric pressure forces the valve closed due to a sealing action of the liquid from the container that is between the valve member and its mating seat which are complementary frusto-conical shapes.

To preclude accidentally opening the closure by compression of the container as described above, a locking arrangement is provided which locks the valve member closed. The locking action requires the valve member to be rotated between open and closed positions. A relatively small arrow on the valve member stem upper surface is raised somewhat above the stem upper surface to indicate the open-closed position of the valve member relative to indicia on the valve body.

The valve member stem projects vertically above the conical valve member. To permit liquid to escape to the ambient, a discharge channel is formed in the side surface of the valve stem in communication with the valve body chamber in which the valve member is located. The channel is formed on the stem side surface so as to not interfere with the closed-open position indicating arrow. Because the stem is relatively small in diameter, the arrow is also relatively small.

The arrow projecting above the stem is intended to serve as a finger gripping device for rotating the stem and valve member attached thereto to the open and locked positions. The arrow, however, needs to be relatively small to accommodate the liquid dispensing port. Due to the relatively small size, i.e., length and height of the arrow, in practice it is difficult to grasp the arrow in order to rotate the valve and as a result, this device has met with little success. To provide a larger gripping device, the arrow would overlie the channel, and would interfere with the dispensing from the channel. The arrow is required in order to give directions to the user as to the position of the valve in the open and closed states.

The present inventor recognizes that a conflict is presented in solving this problem in that the gripping device needs to be rotated and that the dispensing channel should be small in diameter to control the liquid flow to a small stream. Such a stream could be interfered with if the gripping device is made larger. The copending application addresses this problem.

A second problem is that as described in the aforementioned copending application and in the prior U.S. Pat. No. '536, the valve has a full open condition and a full closed condition. However, the interface between the valve seat and the valve member when filled with a fluid to provide the desired sealing action may be provided different clearances to allow for different fluid viscosities. That is, the sealing action to assure automatic closing of the valve depends upon the valve clearance and the fluid viscosity. Different valves are provided different maximum clearances to accommodate such different viscosities.

The above latter problem is resolved with a closure for dispensing a fluid stored in a squeezable resilient container according to the present invention which comprises a housing having a valve cavity. Means are provided for securing the housing to the container with the cavity in fluid communication with the container interior.

A valve seat is coupled to the housing in the cavity. A valve member with a male valve having a surface complementary to the seat provides a substantially fluid tight seal in a seated closed valve position and provides a fluid passage at the interface between the valve surface and the seat in an open valve position. Valve member rotating means are secured to the valve member for manually rotating the valve member.

The valve member axially displaces along an axis in response to pressurized stored fluid in the container applied thereto so that the valve member displaces to the open valve position along the axis and the fluid enters into and forms a seal at the interface. Valve member displacement limiting means having locked and unlocked states is coupled to the housing and valve member for settably limiting the maximum distance the valve member is permitted to axially displace to an open valve position from the closed valve position in the unlocked state to provide a settable range of maximum clearances in the interface between the valve member surface and seat from the closed valve position to a fully open valve position such that fluid in the interface tends to effectively seal the interface from passing ambient air therethrough when the container interior pressure is less than ambient pressure to thereby force the valve member to its closed valve position. Locking means lock the valve member in the closed valve state.

In one aspect, the rotating means include a valve stem extending from the valve along the axis and having a top portion in communication with the ambient atmosphere, the stem having fluid discharge passage means in communication with the interface.

In a further aspect, the valve member has an annular shoulder and the housing has an annular wall complementary to and facing the shoulder for selectively engaging the shoulder to form the limiting means.

In a still further aspect, the shoulder and the wall each ramp toward and away from one another in contiguous gradual curves.

The shoulder and the wall may form mating cam surfaces for providing continuous gradual increase in adjustable maximum clearance.

The valve rotating means may include a knob, the housing and knob each including mating indicia for indicating the setting of the relative value of the adjustable maximum clearance.

The valve member may have an annular shoulder that varies gradually relative to its position from the valve surface between a minimum value in a first circumferential valve member position to a maximum value in a second valve member cirfumferential position, the housing including an upper ramped wall in the cavity spaced a first minimum distance from and facing the shoulder at one annular location of the housing an amount sufficient to axially lock the valve member in the closed position when the shoulder at the maximum value is at the one location and a plurality of second different distances greater than the first minimum distance at a corresponding plurality of second annular locations an amount sufficiently great to permit the valve member to displace settable different corresponding displacement distances to a maximum displacement distance in accordance with the relative annular position of the shoulder maximum value to the wall.

Figure 3:
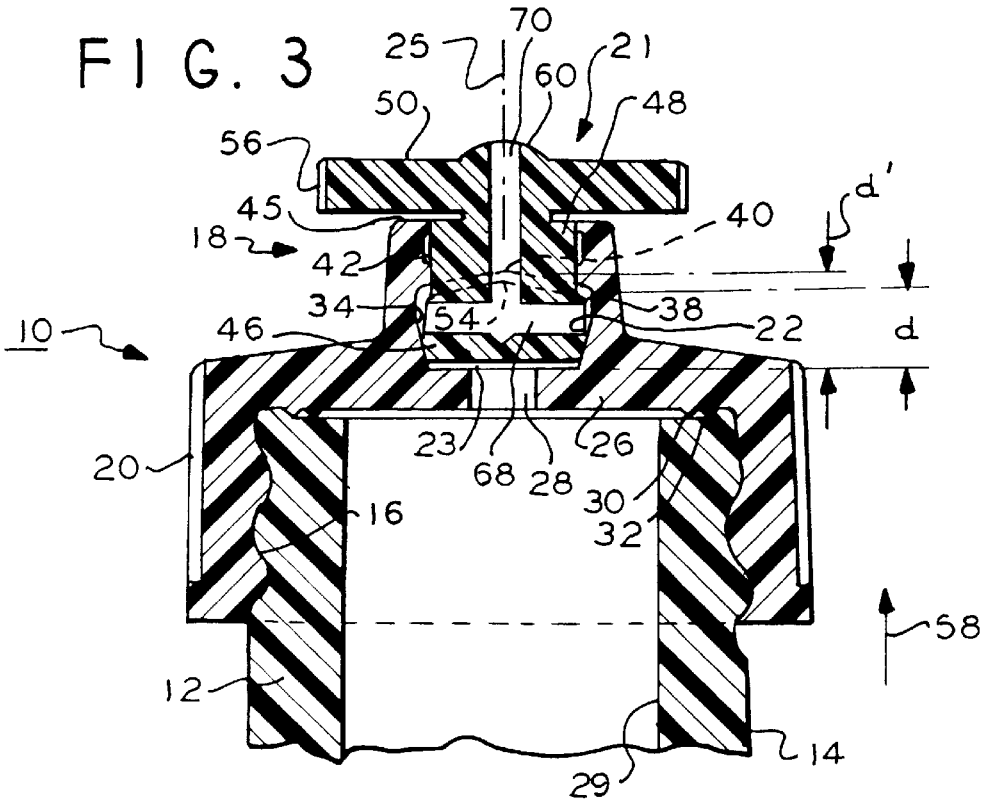
FIG. 3 is a sectional side elevation view of the closure of FIGS. 1 and 2 showing the valve in the unlocked closed valve position.
Figure 4:
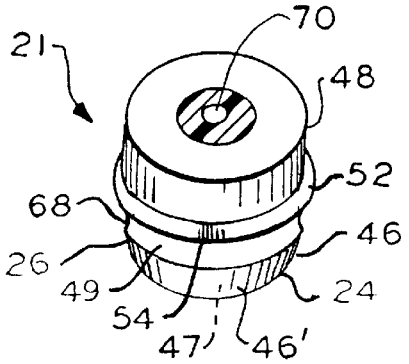
FIG. 4 is an isometric fragmented view of the valve member of the closure of FIGS. 1 and 2 with the handle broken away for clarity of illustration.
Figure 4A:
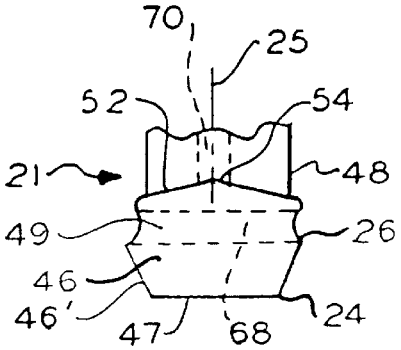
Figure 6:
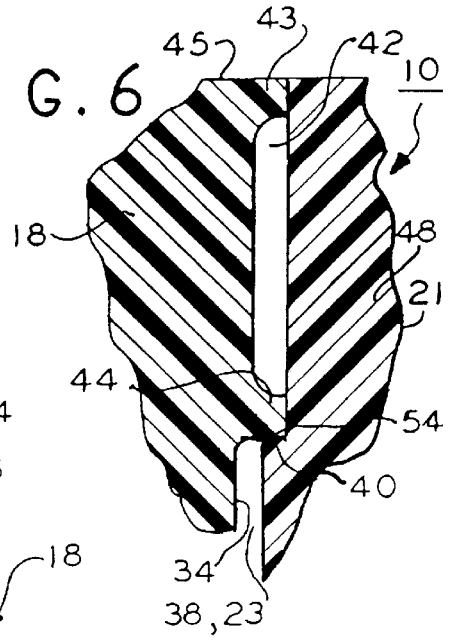
Figure 5:
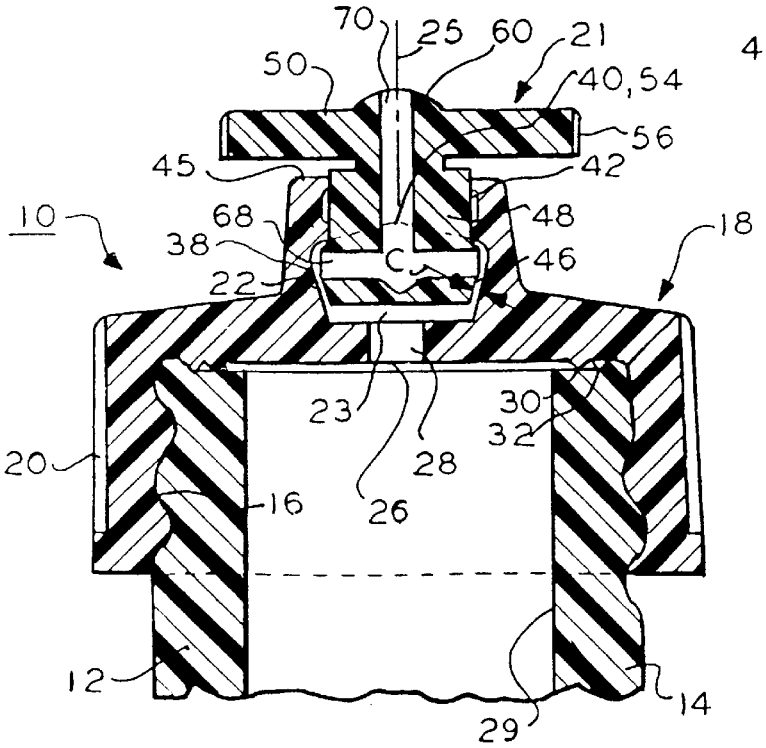
Figure 5:
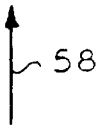
Figure 7:
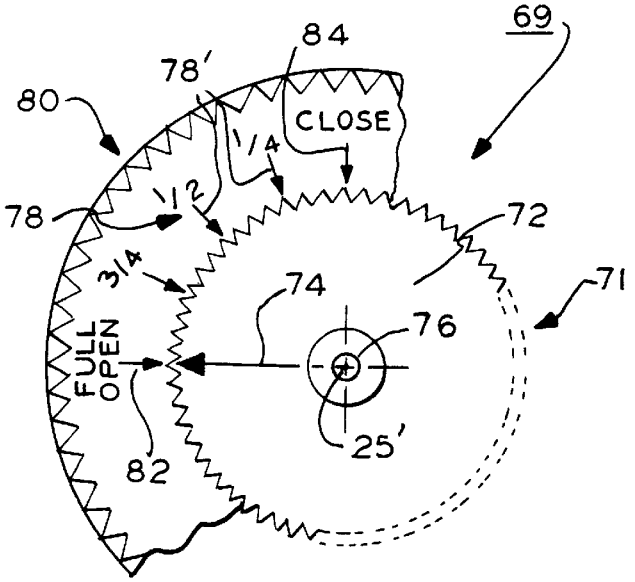
Figure 9:
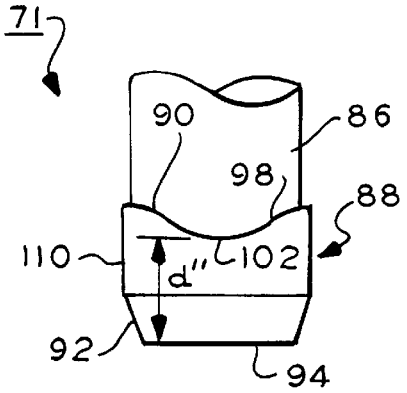
Figure 8:
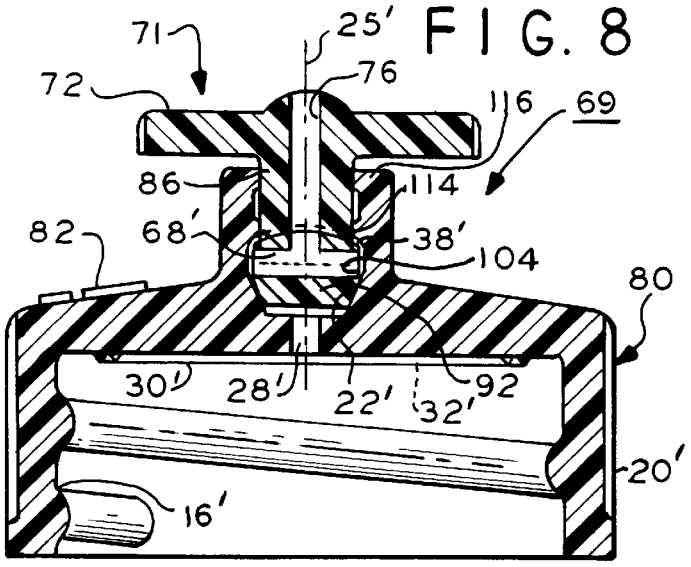
Figure 10:
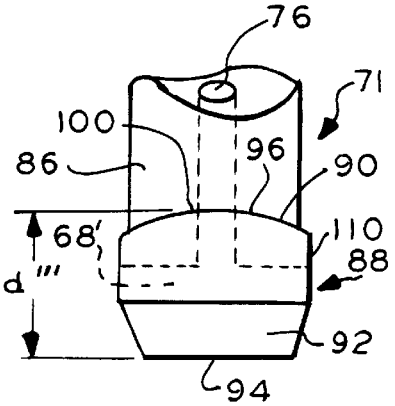
Figure 12:
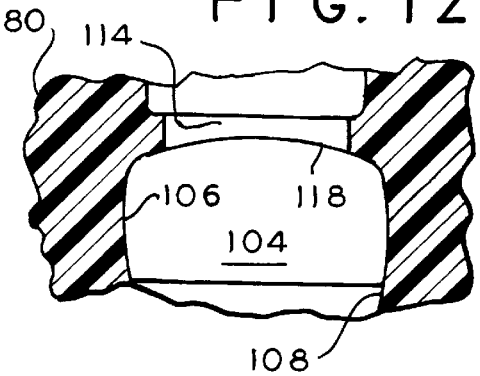
Figure 11:
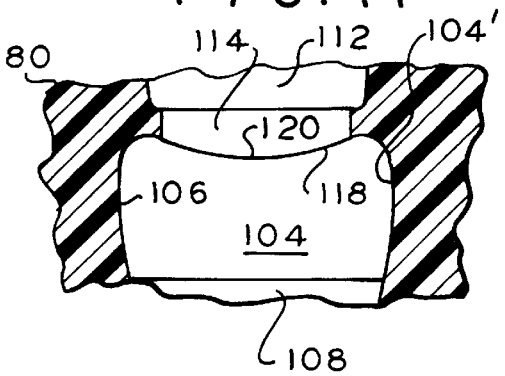

FIG. 4*a* is a side elevation view of the valve member stem portion of FIG. 4 showing the locking arrangement;

FIG. 5 is a sectional side elevation view of the closure similar to the view of FIG. 3 but with the valve in the open position;

FIG. 6 is a sectional view of a portion of the closure and valve in the closed locked position;

FIG. 7 is a fragmented top plan view of a closure according to a second embodiment of the present invention;

FIG. 8 is a sectional elevation view of the closure of FIG. 7;

FIGS. 9 and 10 are fragmented elevation views of the male valve and stem of FIG. 8 in two orthogonal orientations, FIG. 10 corresponding to the view of FIG. 8; and FIGS. 11 and 12 are two orthogonal views of a housing valve chamber portion, FIG. 12 corresponding to the view of FIG. 8.

Figure 1:
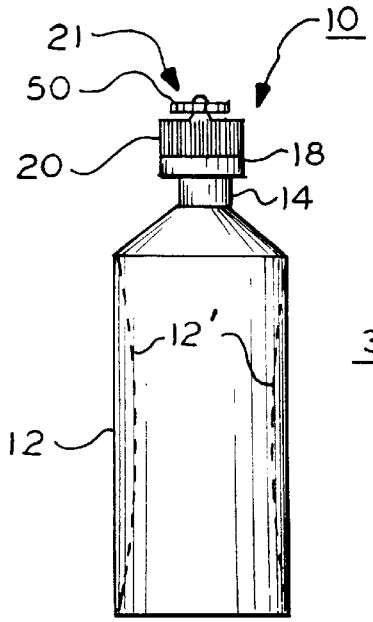
FIG. 1 is an elevation view of a closure embodying the present invention mounted on a squeezable container.

In FIG. 1, the closure 10 embodying the present invention is illustrated as being usable with a plastic squeezable container 12 for various fluids, including liquids, pastes and the like. The container 12 is of thermoplastic molded pliable material. By depressing the container 12 at the sides, the container depresses or "squeezes" as shown dashed at 12'. The sides have memory, and being resilient, return to their original state (solid lines) when released. The container 12 and closure 10 generally have the structure of the closure disclosed in the aforementioned U.S. Pat. No. 4,203,536 incorporated by reference herein.

The container squeezed condition increases the pressure in the container above ambient atmosphere and forces the contents from the container through the closure 10 discharge orifice as will be described. The closure 10 has a locked state, FIG. 6, with the valve closed, FIG. 3, to prevent the contents of the container from discharging unintentionally in case of accidental squeezing as might occur during transit.

Container 12 has a threaded throat 14 on which the closure 10 is mounted via internal threads 16, FIG. 3, formed in housing 18. The closure 10 comprises a housing 18 and a valve member 21. The housing 18 external peripheral surface has serrations 20 to aid the user to mount and demount the closure 10 on the container 12. Any other fastening devices may be used instead of threads as may be convenient for a particular implementation. Housing 18 may be formed of any suitable flexible material.

Internal to housing 18 is a cavity 23 in which is a tapered valve seat 22. Seat 22 preferably is frusto-conical with its smallest diameter 24, FIGS. 4 and 4*a*, closest to container 12 and its largest diameter 26 distal the container 12. The slope of the seat 22 surface is about 10° with the vertical axis 25. This angle is not critical and can vary somewhat from this value which is given by way of example. Seat 22 surrounds and forms a side wall of cavity 23. Immediately above seat 22 is side wall 34 of cavity 23.

Conduit 28 is centrally positioned on axis 25 within the cavity 23 bottom wall 26 and provides fluid communication between the cavity 23 and the container 12 interior 29. A pair of spaced annular container sealing ribs 30 and 32 with a triangular sectional shape depend from the lower surface of housing 18 interior the threads 16. The ribs 30 and 32 are one piece integrally molded with the housing which is preferably molded thermoplastic material. The ribs 30 and 32 engage the upper lip of the container 12 for sealing cavity 23 to the container interior 29. In the alternative, a gasket ring (not shown) may be used to seal the lip of the container to housing 18.

Figure 2:
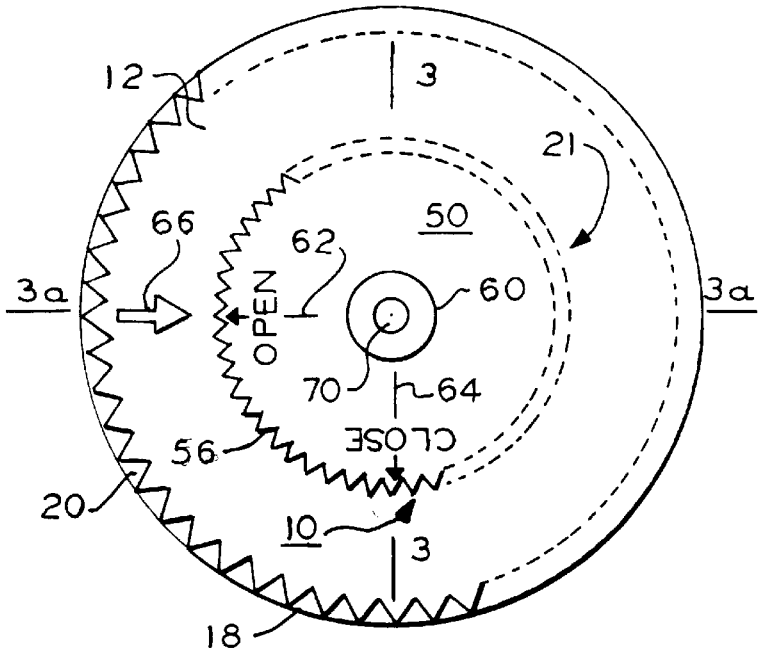
FIG. 2 is a top plan view of the closure of FIG. 1.

The upper edge of seat 22 terminates at circular cylindrical upstanding side wall 34 to form an interior chamber 38 in the cavity 23. Chamber 38 has an upper ceiling wall 40 which terminates at side wall 34. Wall 40 slopes for providing locking action as will be described. Wall 40 along lines 3—3, FIG. 2, is spaced a minimum distance d (the height of wall 34) from bottom wall 26. Wall 40 along lines 3*a*—3*a* FIG. 2, is spaced a maximum distance d' from bottom wall 26, lines 3*a*—3*a* being 90° from lines 3—3. Wall 40 slopes smoothly from distance d to distance d' in a continuous smooth downwardly facing shoulder. Distance d' is greater than distance d for providing locking and unlocking action of the valve member 21 as will be explained.

A cylindrical longitudinal stem guide bore 42 concentric with axis 25 is formed in housing 18 open to cavity 23 and chamber 38 at its lower end and to the ambient atmosphere at its upper end. Bore 42 is coaxial with the seat 22 and conduit 28 on axis 25.

In FIG. 6, a pair of sealing ribs 43 and 44 are one piece molded with the housing 18. The ribs 43 and 44 are preferably identical and are somewhat pliable to from a seal with the valve member stem to be described below. The ribs 43 and 44 extend radially inwardly into the bore 42 from the side wall of the bore 42. Rib 42 is adjacent to the housing 18 top surface 45.

Valve member 21, FIGS. 4 and 4*a*, has a valve 46 which is mounted in, mates with and is complementary shaped with seat 22 and a valve stem 48 which is in chamber 38 and extends into the ambient atmosphere through bore 42. When fully seated in seat 22, the valve 46 is closed and no fluid can pass in the interface between the valve 46 and seat 22. The bottom surface 47 of valve 46 is flat and is spaced from the housing bottom wall 34 when the valve is closed, FIG. 3.

The tapered surface 46' of valve 46 terminates at its upper extremity in a circular cylindrical portion 49. Shoulder 52 tapers downwardly and radially outwardly from its more central portion adjacent to the stem 48 to the cylindrical portion 49. The taper of shoulder 52 is similar to the taper in ceiling wall 40 of chamber 38 which tapers in complementary fashion.

Two radially outwardly and upwardly extending crests or ridges 54 (one shown) at the upper crest of the shoulder 52 are at diametrically opposite sides of valve 46. These crest ridges and shoulder are molded integral with valve 46 in this example. The shoulder 52 slopes gradually from the ridges 54 from a maximum distance from bottom surface 47 at the ridges (along axis 25, FIG. 3) to a minimum distance at the troughs 53 therebetween, FIG. 4*a* (at the left and right hand edges of the shoulder 52 in FIG. 3). The shoulder 52 in its entirety about stem 48 and axis 25 is preferably complementary to the housing upper wall 40 about axis 25. The wall 40 also curves gradually from a maximum distance d' at axis 25 to the base of the chamber 38, FIG. 3, and thus to the valve seat 22 to a minimum distance d distal the axis 25.

When valve 46 is seated in seat 22 in the closed valve condition, FIG. 3, and the ridges 54 are aligned along lines 3*a*—3*a*, FIG. 2, so that the complementary portions of the ceiling wall 40 and shoulder 52 are axially aligned above one another, as shown in FIG. 3, there is a maximum clearance distance between the shoulder 52 including the ridges 54 and the ceiling wall 40. This maximum clearance permits the valve member 21 to displace a maximum value to the open state in the direction of arrow 58. Wall 40 forms a vertical upward displacement stop for valve 46 limiting its displacement from seat 22 to a certain maximum value whose importance will be explained below.

When the valve member 21 is rotated 90° so that the ridges 54 are aligned with imaginary lines 3—3, FIG. 2, the ridges 54 engage ceiling wall 40 at the minimum distance d in the closed valve state. Distance d is made that value such that there is a slight interference fit between ridges 54 and ceiling wall 40 when at this angular position and the valve 46 is fully seated. Since the valve 46, ridges 54 and housing are all made of a somewhat pliable material such as polypropelene or polyethelene, the slight interference fit forces and locks the valve 46 in the closed valve position.

Accidentally applied elevated pressure from within the container interior 29 will not displace the valve 46 from the closed valve position in this locked state. The valve member is rotatable in any direction and thus it does not matter in which direction valve 46 is rotated. When ridges 54 are aligned with lines 3α—3α the valve may open, and when aligned with lines 3—3, the valve 46 is locked closed.

As the valve is rotated from the locked state to the full unlocked positon of FIG. 3, the clearance between the ridges 54 and the wall 40 gradually increases to the maximum value as shown in FIG. 3. That is, as the ridges are rotated about axis 25 the clearance between the ridges and ceiling wall 40 with the valve closed gradually increases from zero to the maximum amount.

The intermediate positions of the ridges between the full locked state and the full open position have gradually increasing clearances between the valve member 21 shoulder 52 and the ceiling wall 40. Thus, when the valve member 21 is rotated to an intermediate position between the locked state and the full open position, the valve can only be displaced to a maximum open position that has a maximum clearance value that is intermediate in value of the maximum clearance of FIG. 3 and the locked condition. By setting the ridges to such an intermediate position, the maximum flow value of the fluid is limited by this clearance value. This clearance value increases in analog fashion to the maximum value of FIG. 3 depending upon the relative annular position of the valve member 21 to the wall 40 about axis 25. Therefore, the valve has a settable maximum opening value. This value is set in accordance with the value of the relative rotation position of the valve member 21 in a 90° range between the full open and closed positions manifested by the indicia 62, 64 and 66 of FIG. 2.

Circular cylindrical stem 48 is integral with valve 46 and extends centrally upwardly from valve 46 concentric with axis 25. Stem 48 axially displaces along axis 25 in bore 42. Stem 48 is closely engaged in sealing contact with the ribs 43 and 44, FIG. 6, an amount sufficient to prevent fluid from seeping therebetween but not so tight so as to prevent stem 48 from displacing in bore 42. Stem 48 serves as a guide for valve 46 to ensure that valve 46 seats properly in seat 22.

A circular disc-like handle knob 50, FIG. 2, is secured to stem 48 via a narrow neck portion. The knob 50 has knurls or serrations 56 on its outer peripheral surface. A raised central portion 60 is on knob 50. Indicia 62 and 64 in the form of text and arrows are on knob 50 to indicate respectively the open and closed positions of the knob relative to arrow indicia 66 on the housing 18. The indicia are molded integral onto the respective surfaces, raised or depressed as desired.

A transverse fluid conduit 68 extends through stem 48 in circular cylindrical portion 49. An additional transverse conduit (not shown) normal to conduit 68 may be further provided according to a given implementation. The stem 48 side wall is circular cylindrical above the valve 46 and below the shoulder 52. The conduit 68 terminates in chamber 38. The conduit 68 extends through the stem 48 normal to axis 25.

A vertical discharge conduit 70 is aligned on axis 25 and is in fluid communication with the conduit 68 at its lower end and with the ambient at its upper end. The conduit 70 passes centrally through the knob 50. Any fluid under pressure in chamber 38 exits the chamber to the ambient through the conduits 68 and 70 and is formed into a relatively small diameter stream with the container inverted.

Rotation of the knob 50 positions the valve 46 in the desired locked or unlocked position, respective lines 3—3 or 3*a*—3*a*, FIG. 2. In FIG. 2, the knob 50 is shown in the unlocked (open) position of FIG. 3. The valve 46 is seated on seat 22, however, and is closed.

FIG. 5 shows the valve opened from the position of FIG. 3 ready to dispense fluid (liquid). When rotated 90° from this position to the locked state, the valve cannot be displaced to the position of FIG. 5 from the position of FIG. 3. When locked, ridges 54 abut ceiling wall 40 and force valve 46 tightly into seat 22. Pressure within container 12 can not open the valve.

The inverted assembly of FIG. 5 discharges a fluid (not shown) as the container 12 is squeezed to increase the internal pressure above ambient. The fluid flows through conduit 28 impinges against valve 46 bottom surface 48, forcing the valve open in the direction of arrow 58. Fluid flows into the interface between seat 22 and the tapered valve surface 46' of valve 46. Because the conduit 28 is centrally positioned and of sufficient flow capacity for the particular fluid, fluid enters into the valve interface in an annular flow completely surrounding the tapered surface 46' of valve 46 and filling the entire interface.

This occurs because the clearance C between seat 22 and valve 46, FIG. 5, is set sufficiently small with respect to the volume of the fluid flowing and its viscosity. That is, the internal pressure at the bottom 48 of valve 46 is sufficiently high with respect to the entire flow area at the interface, such that fluid tends to enter the entire circumferential area of the interface as the fluid emerges from conduit 28. These relationships can be readily determined empirically.

The distance d' (FIG. 3) is chosen to provide sufficient maximum clearance space for ridges 54 so that clearance C (FIG. 5) does not exceed a certain value for a given fluid viscosity. That value is one which permits the valve seat interface to be filled with the fluid and remain filled in an annular continuous ring around valve surface 46' during the container 12 squeezing and subsequent release actions.

It is to be understood that the clearance C is also a function of the fluid viscosity. A more viscous fluid, for example, heavy oil, flows less readily than a less viscous fluid such as water. Thus the interface flow area should be made greater for more viscous fluids than less viscous fluids to form the fluid sealing action. The interface will remain scaled longer (with the container interior pressure at ambient) with a more viscous fluid than with a less viscous fluid for a given clearance. The time the fluid should remain in the interface as a seal is a matter of a few seconds until the valve 46 closes as the container interior 29 pressure becomes less than ambient. The amount of fluid in the interface is not critical as long as the fluid forms a continuous annular ring about valve 46 so that ambient air does not immediately return to the container interior without first closing valve 46.

This fluid ring in the valve interface acts effectively as a seal to ambient air attempting to return to the container 12 interior via the interface 68. Since air can not easily return via this route due to the presence of the fluid in the interface, the greater pressure forces the valve 46 against seat 22, closing the valve automatically and without any spring bias devices. Of course, after the valve 46 is seated, the higher ambient pressure may tend to seep air through the closed interface 68 to equalize the pressure in the container 12 interior with the ambient since the seal may not be a perfect seal. This is acceptable.

The valve will be effectively closed and will remain in that position until the container is again squeezed. To prevent accidental discharge it can be locked, but that is not essential to placing the valve in the closed position. By way of example, for a mean seat diameter of 7/16 inches and a fluid viscosity of about same as S.A.E. 40 oil, the clearance C can have a value of about 1/64 inches.

Thus wall 40 acts as a displacement limiting device for valve 46. This action ensures automatic closure of the valve upon dissipation of back pressure (greater than ambient) in conduit 28 and container interior and upon creation of a negative pressure (less than ambient) in conduit 28. This pressure shift results from the natural return of container 12 from the squeezed (dashed line position 12'—FIG. 1) condition to the stable condition (solid lines—FIG. 1).

The maximum clearance C is adjustable by positioning the valve member shoulder ridges intermediate the maximum clearance and closed locked positions at lines 3*a*—3*a* and 3—3 respectively, FIG. 2. This adjustment is set to accommodate a fluid of a given viscosity in order to assure optimum automatic closure of the valve. That is, for a viscous fluid, the valve may be set to full maximum clearance. For a less viscous fluid that tends to be more watery, the maximum possible clearance is set to a lesser value accordingly.

For example, the clearance may be set a minimum crack maximum value for very low viscosity fluids. The flow of such fluids does not need as large an opening as more viscous fluids for a given flow rate. Therefore, flow is acceptable while at the same time automatic closure of the valve is assured for such low viscosity fluids. As the viscosity of the fluids employed increases, the valve member is rotated to increasing greater maximum possible clearances C until the maximum possible value is reached. These values can be increased gradually in analog fashion as the valve member 21 is rotated.

The knob 50 is dimensioned to overlie a portion of the housing 18 so that the indicia thereon are adjacent when viewed from above in a direction opposite direction 58. The discharge conduit 70 receives fluid from conduit 68 via chamber 38. The conduit 70 being central forms a small stream of fluid during discharge. The knob when rotated does not interfere with the discharge stream. The knob is sufficiently large so as to be gripped by several fingers of a person and is readily grasped for locking and unlocking the valve. The serrations on the periphery of the knob and housing permit good locking and ease of unlocking of the valve.

A further embodiment is shown in FIGS. 7–12. In FIG. 7 closure 69 includes a valve member 71 having a rotatable knob 72 on which is formed an arrow indicia 74. A central conduit 76 corresponding to conduit 70, FIG. 3, is formed in the valve member 71. Indicia 78 is formed on closure housing 80. Indicia 78 includes indicia 78' which are graduated markings showing the relative value of the maximum clearance C between the full open and locked positions at indicia 82, 84 respectively. For example, the "¼" and so on indicia indicates the clearance C is at ¼ the maximum C value in the full open position of the valve member 71.

In FIG. 8, structure that is similar to the structure in FIG. 3, has the same reference numerals primed. For example conduit 68' is transverse the stem 86 normal to conduit 76. The valve 46' corresponds to valve 46 and so on. The stem 86 is narrower than stem 48 and there is no undercut between the stem 86 and the knob 80.

In FIGS. 9 and 10, the valve member 71 stem 86 is a circular cylindrical cylinder that terminates at male valve 88. The valve 88 is a circular cylinder of larger diameter than the stem 86 forming a shoulder 90 at their junction. The valve 88 has a frusto-conical valve surface 92 which mates with valve seat 22' in housing 80.

Shoulder 90 varies gradually from a minimum distance d" from the valve member 71 bottom surface 94 to a maximum distance d"'. Shoulder 90 comprises merging circular radii from respective convex to concave shoulder regions 96 and 98. Shoulder 90 has a crest 100 at maximum distance d"' and a trough 102 at minimum distance d". The crest and trough merge gradually s shown.

The housing 80, FIGS. 11 and 12, has a cavity 104 formed with side wall 106 which is frusto-conical (FIG. 8) in a lower portion 108 thereof for mating with valve member 71 frusto-conical valve surface 92. The upper portion of the cavity 104 forms a chamber which receives the upper cylindrical portion 110 of valve member 71. The chamber 104' in cavity 104 is in fluid communication with bore 112 in the housing 80. Ribs 114 and 116 are in bore 112 for sealing engaging the stem 86.

The chamber has an annular upper ceiling wall 118. Wall 118 undulates in complementary manner with shoulder 90 of the valve member 71. In FIG. 8 the undulations of wall 118 are in phase with the undulations of shoulder 90. This provides a maximum clearance distance between the shoulder 90 and wall 118 for the valve member to displace to the open valve state. this position corresponds to the position of FIG. 7 wherein indicia 74 is aligned with the full open indicia 82 as shown.

When the valve member 71 and arrow indicia 74 is rotated 90° to the position aligned with the closed indicia 84, the shoulder 90 crest 100 engages the depending crest 120 of the ceiling wall 118, FIG. 11. This locks the valve closed. When the valve member 71 is rotated partially, for example, so that the indicia arrow 74 is aligned with the "¼" indicia, the valve is permitted to open and the valve member 71 shoulder 90 has an axial clearance, axis 25', spacing to the depending ceiling wall 118 that is ¼ of the spacing of the full open relative positions of FIG. 8. This ¼ spacing represents the maximum possible open displacement of the valve member.

Similarly, when the arrow indicia 74 points to the ½ or ¾ indicia the maximum possible permitted axial displacement of the valve member is a corresponding percentage of the full open displacement. This displacement is limited by the clearance between the shoulder 90 and the wall 118 at these positions. It will occur that the clearance maximum between the shoulder and the ceiling wall 118 can be changed by rotation of the valve member accordingly. The serrations on the knob 72 periphery serve as calibrations for so adjusting the angular position of the valve member relative to the housing 80.

The setting of the different clearance values can be made to correspond to a given fluid viscosity so that the automatic closing feature of the closure 69 is implemented. The mating complementary circular ramp configurations of the shoulder 90 and wall 118 permit fine tuning of the valve open value to correspond to a wide range of fluid viscosities. the actual maximum clearance distance value can be set in accordance with a given implementation. If for example very viscous liquids are contemplated, the maximum clearance and open value can be set accordingly high. If a range of less viscous liquids are contemplated for use with the closure, then the design can incorporate a reduced maximum possible valve open value.

Whether the crest of the shoulder is a discrete ridge or a gradually varying curve depends upon a given implementation. The common aspect is that the valve can be closed and locked closed or closed and permitted to open when the container is squeezed. The setting of the angular position of the valve member is generally made to correspond to the viscosity of the liquid in the container. Of course, if the automatic closure feature is not desired then the opening can be set at any desired value regardless the fluid viscosity and the valve closed manually.

It will occur to one of ordinary skill that various modifications may be made to the disclosed embodiments without departing from the scope of the appended claims.

What is claimed is:

1. A closure for dispensing a fluid stored in a squeezable resilient container comprising:

a housing having a valve cavity;

means for securing the housing to the container with the cavity in fluid communication with the container interior;

a valve seat coupled to the housing in said cavity;

a valve member with a male valve having a surface complementary to said seat for providing a substantially fluid tight seal in a seated closed valve position and for providing a fluid passage at the interface between said valve surface and said seat in an open valve position;

valve member rotating means secured to said valve member for manually rotating said valve member;

said valve member for axially displacing along an axis in response to pressurized stored fluid in said container applied thereto so that said valve member displaces to the open valve position along said axis and said fluid enters into and forms a seal at said interface;

valve member displacement limiting means having locked and unlocked states coupled to said housing and valve member for settably limiting the maximum distance said valve member is permitted to axially displace to an open valve position from the closed valve position in the unlocked state to provide a settable range of maximum clearances in said interface between the valve member surface and seat from the closed valve position to a fully open valve position such that fluid in said interface tends to effectively seal said interface from passing ambient air therethrough when the container interior pressure is less than ambient pressure to thereby force said valve member to its closed valve position; and locking means for locking the valve member in the closed valve state.

2. The closure of claim 1 wherein said rotating means including a valve stem extending from said valve along said axis and having a top portion in communication with the ambient atmosphere, said stem having fluid discharge passage means in communication with said interface.

3. The closure of claim 1 wherein said valve member has an annular shoulder and said housing has an annular wall complementary to and facing said shoulder for selectively engaging the shoulder to form said limiting means.

4. The closure of claim 3 wherein said shoulder and said wall are each ramp toward and away from one another in contiguous gradual curves.

5. The closure of claim 3 wherein said shoulder and said wall form mating cam surfaces for providing continuous gradual increase in said adjustable maximum clearance.

6. The closure of claim 1 wherein said valve rotating means includes a knob, said housing and knob each including mating indicia for indicating the setting of the relative value of said adjustable maximum clearance.

7. The closure of claim 1 wherein said valve member has an annular shoulder that varies gradually relative to said valve surface between a minimum distance value in a first circumferential valve member position to a maximum distance value in a second valve member cirfumferential position, said housing including an upper ramped wall in the cavity spaced a first minimum distance from and facing said shoulder at one annular location of the housing an amount sufficient to axially lock said valve member in the closed position when said shoulder at said maximum distance value is at said one location and a plurality of second different distances greater than said first minimum distance at a corresponding plurality of second annular locations an amount sufficiently great to permit said valve member to displace settable different corresponding displacement distances to a maximum displacement distance in accordance with the relative annular position of said shoulder maximum distance value to said wall.

8. The closure of claim 7 wherein said shoulder and ramped wall are complementary.

9. A fluid dispensing closure for a squeezable resilient container which after squeezing tends to return to a normal stable condition creating a pressure lower than atmospheric within the container interior comprising:

a housing having a passage therethrough;

means for securing the housing to said container with the passage in fluid communication with the container interior;

valve means including a tapered male valve member and a tapered mating valve seat on said housing in said passage and having open and closed valve positions for opening and closing said passage at the valve member and seat interface, said valve member including a stem and rotatably and axially movably secured to the housing for rotation about and displacement along an axis and responsive to a fluid pressure greater than atmospheric in said container for displacing to the open valve position to permit fluid in said container to enter the valve interface;

means secured to said valve stem for manually rotating said stem and member about the axis;

conduit means fluid coupled to said passage and valve means for effecting discharge of fluid to the ambient atmosphere in response to pressurized fluid forced into said passage from said container;

valve member displacement limiting means coupled to said housing and valve member for adjustably limiting the axial displacement of said member between the closed and opened valve positions to different maximum displacement values in accordance with the annular relative position of the valve means to the housing to provide a settable maximum clearance between said member and said seat at each said relative positions to that clearance value at which fluid in said interface tends to effectively prevent ambient air from passing through said interface to said interior during the return of the container to the stable condition, the pressure differential during said return being sufficient to force said valve member to its closed valve position.

10. The closure of claim 9 wherein said valve member and housing including valve locking means for axially locking said member in the closed valve position in one annular position of the member about the axis and for releasing said valve member in a plurality of further settable annular positions.

11. The closure of claim 9 wherein valve member has an annular shoulder with a gradually tapering surface and said housing in said passage has a wall complementary to said shoulder.

12. The closure of claim 9 wherein said stem includes a knob adjacent to said housing, the housing and knob having cooperating mating indicia for identifying said open and locked positions and for identifying a plurality of intermediate positions at which the open position clearance between said valve member and seat is set at corresponding maximum value.

13. The closure of claim 9 wherein the valve member has opposing sides on said axis and an annular shoulder circumscribing the member, said housing passage forming a chamber on one side of said member and an orifice on the other side of said member, said orifice for fluid communication with said interior and said interface, said passage having a gradually sloping annular upper wall which at one annular position is axially closer to said member shoulder at one location on the shoulder than at a plurality of second different annular positions of said wall as said member is relatively rotated, said member shoulder gradually tapering for engaging said upper wall in said one position to force and lock the member in the closed valve position and for selectively engaging said upper wall in a plurality of different annular positions while said member is in the open valve state to selectively set the maximum clearance to corresponding different values.

14. A closure for a squeezable container comprising:

a housing having a cavity defining an axis and a bore in fluid communication with the ambient atmosphere along the axis and with the cavity;

means for securing the housing to said container;

a tapered annular valve seat defining a fluid aperture and located in said cavity;

an annular valve member having a valve surface for displacement within the cavity along an axis and mating with said seat for closing the aperture in one axial position and opening the aperture via the interface between the valve surface and the seat in a second axial position;

a stem secured to said valve member sealingly engaged with said housing in said bore for axial displacement in said bore along said axis;

a first fluid conduit in said valve member transverse said axis in fluid communication with said cavity intermediate the valve surface and stem;

a second fluid conduit in said valve member extending along said axis for fluid coupling the transverse conduit to the ambient atmosphere through said stem;

said housing cavity having a chamber with an upper wall, said valve member being disposed in said chamber;

said stem having a dimension transverse the axis less than the diameter of said valve member to form a shoulder on said valve member facing said upper wall, said shoulder and upper wall tapering gradually about said axis toward and away from one another;

said chamber upper wall being complementary to said shoulder so that the member can be axially displaced from said seat in a plurality of relative annular positions of the shoulder to the wall, a further one of said relative annular positions for axially locking the valve member in the closed valve state, the wall and shoulder for settably limiting the displacement of said member away from said seat to different displacement values in accordance with the relative annular position of the shoulder to the wall to thereby provide a settable interface clearance between said valve surface and said seat from a closed state to a fully open state which clearance permits fluid from said container to flow through said interface and which interface clearance is sufficiently small to permit said fluid to form a fluid seal therebetween in the open valve position in accordance with the viscosity of the fluid whereby ambient pressure when greater than the interior container pressure forces said valve member axially into said seat to the closed valve position.

15. A closure for dispensing a fluid stored in a squeezable resilient container comprising:

a housing having a valve cavity, said cavity having an inlet conduit at a distal housing end, an intermediate valve chamber and a stem receiving bore at a housing proximal end all defining an axis, said valve chamber having an upper ceiling wall adjacent to said bore;

means for securing the housing in fluid communication with the container interior;

a frusto-conical valve seat in said chamber;

a valve member on said axis rotatably secured to the housing for rotation about said axis and including a valve adjacent the distal end for mating with said valve seat at an interface therebetween, said valve member having a cylindrical portion in said chamber adjacent to said valve and medial the valve member along said axis and a stem in said bore extending from said cylindrical portion along said axis to said proximal end, said valve having a valve surface complementary to said seat for providing closed and open valve states, said valve stem having a top portion in communication with the ambient atmosphere at said proximal end;

a knob secured to said valve stem top portion external the housing for manually rotating said stem and valve member about the axis, said handle overlying a portion of said housing;

said interface in fluid communication with said stored fluid so that fluid forced against said valve member axially displaces said valve member to the open valve position along said axis and said fluid enters into and substantially forms a seal with said interface;

said valve member having a fluid receiving conduit transverse to said axis in said cylindrical portion in fluid communication with said chamber and interface, and a fluid discharge conduit coupled to the cavity and extending along said valve stem through said handle to ambient atmosphere; and a shoulder on said valve member extending in an axial direction toward said proximal end for selectively engaging the ceiling wall to adjustably limit and set the maximum distance said valve member is permitted to axially displace to an open valve position from the closed valve position in a plurality of first annular positions of said valve member about the axis, each annular position corresponding to a different predetermined settable maximum clearance value of said interface from a closed valve state to a fully open valve state, said shoulder for selectively engaging the ceiling wall in a second angular position of the valve member about the axis for axially locking the valve in a closed valve state.

16. The closure of claim 15 wherein the valve member maximum displacement increases gradually from the locked closed valve state to a maximum clearance value in a valve full open position.

* * * * *